United States Patent [19]

Bishop et al.

[11] 4,387,885

[45] Jun. 14, 1983

[54] SHOCK ABSORBER ASSEMBLY FOR ABSORBING SHOCKS ENCOUNTERED BY A DRILL STRING

[75] Inventors: Thomas R. Bishop; Roger D. Chancey; Wayne A. Kovar, all of Houston, Tex.

[73] Assignee: Bowen Tools, Inc., Houston, Tex.

[21] Appl. No.: 375,962

[22] Filed: May 7, 1982

Related U.S. Application Data

[63] Continuation of Ser. No. 130,983, Mar. 17, 1980, abandoned.

[51] Int. Cl.[3] ..... F16F 9/18; E21B 17/00

[52] U.S. Cl. ..... 267/125; 175/321; 464/20

[58] Field of Search ..... 267/64.11, 64.13, 125; 175/65, 299, 320, 321; 464/23, 20, 19, 163

[56] References Cited

U.S. PATENT DOCUMENTS

| | | | |
|---|---|---|---|
| 1,967,640 | 7/1934 | Wallace | 267/64.11 |
| 2,025,100 | 12/1935 | Gill et al. | 175/321 |
| 2,240,519 | 5/1941 | Reed | 175/299 |
| 2,520,306 | 8/1950 | Detweiler | 267/125 |
| 2,711,313 | 6/1955 | Zumwalt | 267/64.13 |
| 2,712,435 | 7/1955 | Allen | 267/137 |
| 2,766,037 | 10/1956 | Taylor | 267/64.13 |
| 2,953,352 | 9/1960 | Webb | 267/125 |
| 2,987,129 | 6/1961 | Webb | 175/321 |
| 2,990,895 | 7/1961 | Works et al. | 175/320 |
| 3,033,011 | 5/1962 | Garrett | 175/321 |
| 3,186,702 | 6/1965 | Taylor | 267/64 A |
| 3,225,566 | 12/1965 | Leathers | 464/18 |
| 3,281,166 | 10/1966 | Doughty, Jr. et al. | 248/20 |
| 3,350,900 | 11/1967 | Harrison | 464/18 |
| 3,606,297 | 9/1971 | Webb | 267/125 |
| 3,815,692 | 6/1974 | Varley | 175/65 |
| 3,949,150 | 4/1976 | Mason et al. | 175/321 |
| 3,998,443 | 12/1976 | Webb | 267/125 |
| 4,031,716 | 6/1977 | Zabcik | 64/23 |
| 4,055,338 | 10/1977 | Dyer | 267/125 |
| 4,067,405 | 1/1978 | Bassinger | 175/321 |
| 4,130,000 | 12/1978 | Burge | 64/1 V |
| 4,133,516 | 1/1979 | Jurgens | 267/125 |
| 4,145,034 | 3/1979 | Dyer | 267/125 |
| 4,171,025 | 10/1979 | Bassinger | 175/65 |
| 4,331,006 | 5/1982 | Bishop | 267/125 |

FOREIGN PATENT DOCUMENTS

| | | | |
|---|---|---|---|
| 1258722 | 3/1961 | France | 175/321 |
| 644934 | 1/1979 | U.S.S.R. | 175/321 |

*Primary Examiner*—Douglas C. Butler
*Assistant Examiner*—Robert Oberleitner
*Attorney, Agent, or Firm*—Pravel, Gambrell, Hewitt, Kirk & Kimball

[57] ABSTRACT

A shock absorber assembly for absorbing shocks encountered by a drill string wherein the shock absorber assembly is for use with a drill string having a working fluid therein and includes a body member affixed to the drill string, a mandrel mounted for reciprocal longitudinal movement with respect to the body member and a fluid dampening member floated within the central bore of the body member in engagement with the body member and the mandrel for absorbing shocks transmitted between the body member and the mandrel.

11 Claims, 6 Drawing Figures

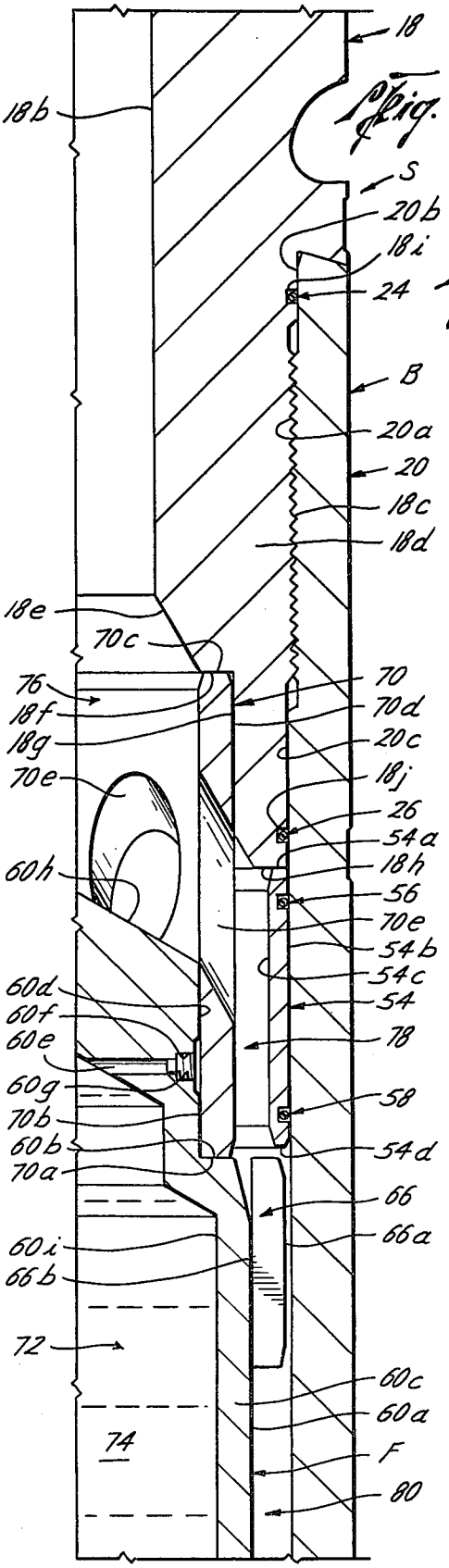
Fig. 2A
Fig. 2B
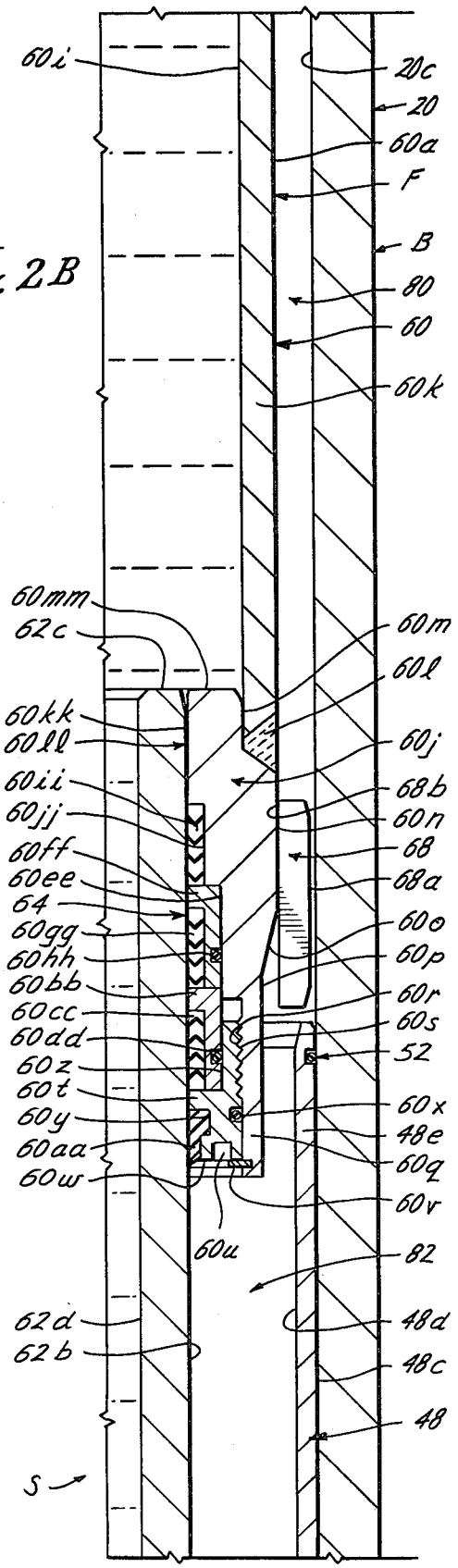

SHOCK ABSORBER ASSEMBLY FOR ABSORBING SHOCKS ENCOUNTERED BY A DRILL STRING

This is a continuation, of application Ser. No. 130,983, filed Mar. 17, 1980 now abandoned.

FIELD OF THE INVENTION

The field of this invention relates to devices used in the absorption of intermittent shocks and vibrations, particularly of the type used in conjunction with a drill string.

DESCRIPTION OF THE PRIOR ART

Shock absorbing devices have long been used in the rotary well drilling industry for reducing shocks and vibrations encountered by the drilling bit during drilling operations while penetrating through rock formations having varying, inconsistent layers. In an effort to reduce the shocks and vibrations, many types of shock absorbing devices have been used. Some include devices utilizing springs for isolating such shocks between two movable members such as disclosed in U.S. Pat. Nos. 3,281,166 and 4,133,516. Other devices include the use of resilient, rubber pads for attempting to insulate and pad such shocks as shown in U.S. Pat. Nos. 3,949,150 and 4,130,000. U.S. Pat. No. 2,712,435 uses a combination of springs and fluid cavities to effectuate the desired shock absorbing function. Other techniques have incorporated what is known as a "floating piston" design such as disclosed in U.S. Pat. Nos. 3,606,297; 3,815,692; 4,031,716; 4,055,338; 4,067,405; 4,145,304; and 4,171,025. U.S. Pat. No.3,998,443 discloses a multidirectional shock absorbing device while U.S. Pat. No. 3,350,900 utilizes a differential area concept in order to effectuate shock cushioning of a rotary driving well tool.

U.S. Pat. No. 3,225,566 discloses a drill string shock absorber utilizing an annular piston adapted to move within an annular chamber that is filled with a compressible fluid, with the action of the annular piston against the compressible fluid providing the dampening force for effectuating the shock absorber function. However, so far as known, such a tool as disclosed in the U.S. Pat. No. 3,225,566 patent suffers from potential defects because in the event of axial loading such as axial bending, the various sealing components may be subjected to abnormal forces causing leakage thereof. Furthermore, the effectiveness of the shock absorber action may further be hindered because of improper cooling necessary for proper operation of a compressible gas-filled shock absorbing device.

SUMMARY OF THE INVENTION

The present invention relates to a new and improved shock absorber assembly and method of using same for absorbing shocks encountered by a drill string, wherein the shock absorber assembly includes a body member affixed to a drill string and in communication with the working fluid of the drill string, a mandrel mounted for reciprocal longitudinal movement with respect to the body member and for directing the working fluid outwardly from the body member, and a fluid dampening member floated within the central bore of the body member in engagement with the body member and the mandrel for absorbing shocks transmitted between the body member and the mandrel.

BRIEF DESCRIPTION OF THE DRAWINGS

FIG. 2A is an elevational, sectional view of the shock absorber assembly of the present invention as taken along the lines 2A—2A of FIG. 1;

FIG. 2B is an elevational, sectional view of the shock absorber assembly of the present invention taken along the lines 2B—2B of FIG. 1;

DESCRIPTION OF THE PREFERRED EMBODIMENT

Figure 1:
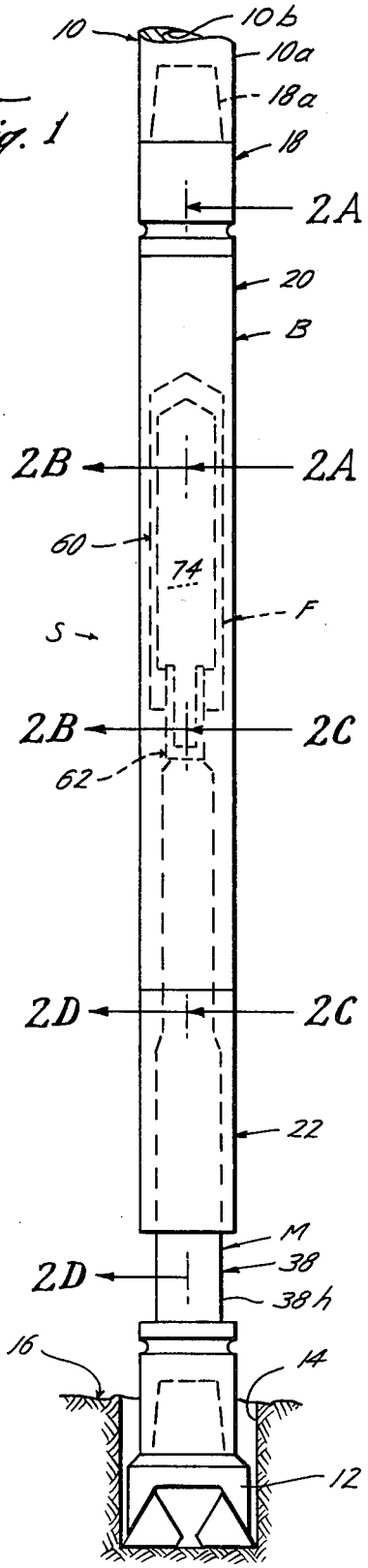
FIG. 1 is an elevational view of the shock absorber assembly of the present invention as schematically used with a drill string.

Referring to the drawings, the shock absorber assembly of the present invention is referred to generally by the letter S. The shock absorber assembly S is adapted to be used with a drill string, such as drill string 10 (FIG. 1) and is preferably positioned between the lower end 10*a* of the drill string 10 and drill bit 12. The drill bit 12, preferably capable of providing a cutting action upon rotation and axial loading thereof, is typically utilized for drilling a suitable well bore 14 in geologic formations 16. The shock absorber assembly S may also be positioned at various other locations in the drill string 10 as is necessary to effectuate appropriate shock absorption functions as is deemed necessary under varying conditions. The shock absorber assembly S includes a body member B, a mandrel M mounted for reciprocal movement with respect to the body member B and fluid dampening means F floated between the body member B and mandrel M as discussed more fully hereinbelow. Unless otherwise noted, it is preferred that the components of this invention be made of suitable high strength materials such as steel or other high grade materials capable of withstandig the significant stresses and strains encountered during typical drilling operations.

The shock absorber assembly S of the present invention includes a body member B. The body member B includes a top sub 18, a middle body 20, and spline body 22. The top sub 18 is adapted to engage the lower end 10*a* of the drill string 10 by suitable threads schematically shown as 18*a* (FIG. 1) for attaching the shock absorber assembly S of the present invention with the drill string 10. The top sub 18 is formed preferably having a bore 18*b* formed therein which is substantially the same diameter as the bore 10*b* of the drill string 10 and is adapted to be in fluid communication therewith. The top sub 18 is further formed having threads 18*c* formed adjacent lower end 18*d* thereof. Preferably, a conic annular surface 18*e* is formed adjacent bore 18*b* adjacent the lower end 18*d* of the top sub 18 with radial surface 18*f* formed adjacent thereto. Annular surface 18*g* is formed adjacent to radial surface 18*f* with end surface 18*h* being formed adjacent thereto. Preferably, seal detents 18*i*, 18*j* are formed above and below the threads 18*c* for receiving seals 24, 26, respectively.

The body member B further includes a middle body 20 which is threadedly affixed to the top sub 18 by threads 20*a* of middle body 20 threadedly engaging threads 18*c* of the top sub 18. Inner surfaces 20*b*, 20*c* permit a sealable relation to exist between the seals 24, 26, respectively, when the middle body 20 is threadedly affixed with the top sub 18. Preferably, suitable threads 20*d* (FIG. 2C) are formed adjacent the lower end 20*e* of the middle body 20 with seal surface 20*f* formed adjacent to the threads 20*d*.

The body member B further includes spline body 22 which is threadedly affixed to middle body 20 by threads 22*a* threadedly engaging threads 20*d* of the middle body 20. Seal detents 22*b*, 22*c* are formed above and below threads 22*a* for receiving seals 28, 30, respectively, with such seals 28, 30 engaging surfaces 20*c*, 20*f* of middle body 20 for insuring a fluid tight relation therebetween. End surface 22*d* (FIG. 2C) is formed adjacent the upper end 22*e* of the spline body 22. The spline body 22 is formed having a plurality of spline grooves 22*f* that extend longitudinally along the spline body 22 in parallel relation to bore 22*g* of the spline body 22 and annularly about the spline body 22. A recessed surface 22*h* is formed adjacent to the splined grooves 22*f* with bearing detent 22*i*, packing detent 22*j*, and wiper detent 22*k* formed adjacent thereto at the lower end 22*l* of the spline body 22. A suitable bearing 32, such as formed of a metal softer than that of the body member B, is adapted to be mounted within the bearing detent 22*i* while spline body packing 34 is mounted within packing detent 22*j*. Preferably, the spline body packing 34 includes spacers 34*a* which may be made of asbestos or any other suitable material for securing the spline body packing 34 in place within the packing detent 22*j*. Spline body wiper 35 is preferably mounted within wiper detent 22*k* for performing wiping functions as is well known and described more fully hereinbelow.

The shock absorber assembly S of the present invention further includes a mandrel M mounted for reciprocal longitudinal movement with respect to the body member B for directing the working fluid outwardly from the body member B to the drill bit 12 as discussed more fully hereinbelow. The mandrel M includes mandrel body 38 having a retainer detent 38*a* formed adjacent its upper end 38*b*. A central bore 38*c* extends along the length of the mandrel body 38 and is of substantially the same inside diameter as the bore 10*b* of the drill string 10 and bore 18*b* of top sub 18. Packing surface 38*d* is formed adjacent upper end 38*b* adjacent to outer annular surface 38*e*. A plurality of longitudinal splines 38*f* are annularly formed with the outer annular surface 38*e* and extend radially outwardly and are adapted to be received within the compatibly formed spline grooves 22*f* of spline body 22. The annular surface 38*e* and longitudinal splines 38*f* adjoin one another adjacent surface 38*g* (FIG. 2D) which is formed to be compatible with surface 22*m* formed between recessed surface 22*h* in bore 22*g* of spline body 22. The exterior surface 38*h* is adapted to engage inner annular surface 32*a* of bearing 32 as well as being in a sealable relation with the inner annular surface 34*b* of spline body packing 34 and the inner annular surface 36*a* of spline body wiper 36. Thus a sealable relation is effectuated upon reciprocal movement of the mandrel M within the spline body 22.

Figure 3:
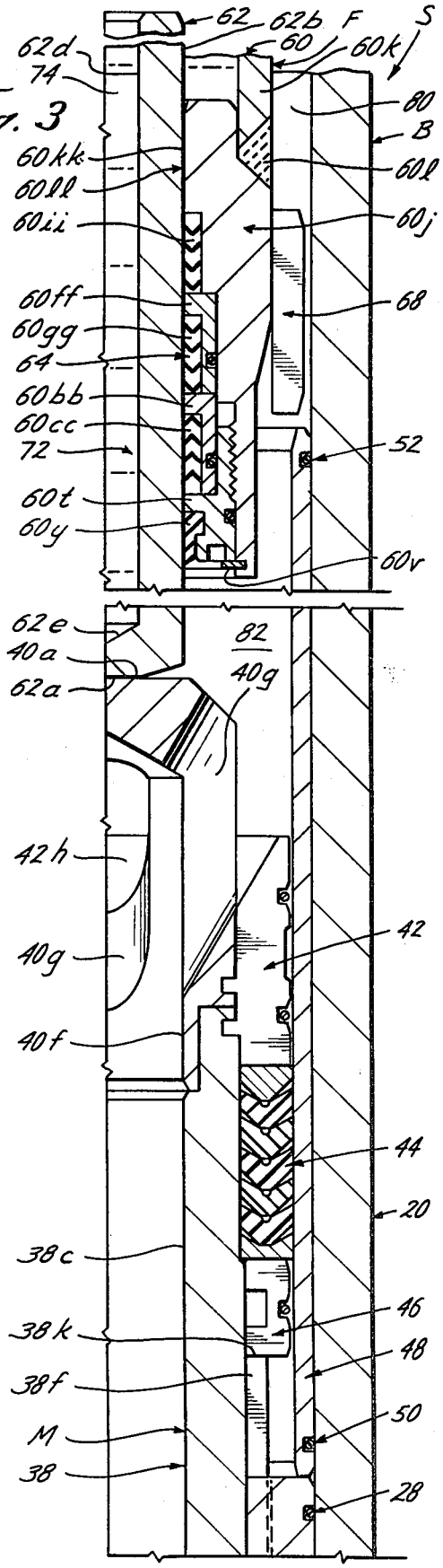

The mandrel M of the shock absorber assembly S of the present invention further includes a mandrel adapter 40 (FIG. 2C) which is adapted to be mounted adjacent the upper end 38*b* of the mandrel body 38. Preerably, the mandrel adapter 40 is formed having an upper end surface 40*a*, an outer annular surface 40*b* having a retainer detent 40*c* formed therein, a radial lip 40*d* formed adjacent thereto, and an annualr surface 40*e* formed adjacent radial lip 40*d*. Furthermore, the mandrel adapter 40 is formed having an inner annular surface 40*f* which is substantially of the same diameter as that of bore 38*c* of the mandrel body 38. Preferably, a plurality of fluid ports 40*g* are formed in the mandrel adapter 40 which extend between the outer annular surface 40*b* to the inner annular surface 40*f*. The mandrel adapter 40 is adapted to engage mandrel body 38 with radial lip 40*d* engaging radial lip 38*i* of the mandrel body 38 and annular surface 40*e* of mandrel adapter 40 in engagement with annular surface 38*j* of mandrel body 38. The mandrel body 38 and mandrel adapter 40 are secured together by retainer 42. Preferably, the retainer 42 is of a "split-body" configuration (not shown) that is made up of multiple compoent body parts with such body parts being secured together by suitable retainer rings 42*a*, 42*b* which are adapted to be received in retainer ring detents 42*c* , 42*d*, respectively. The inner annular surface 42*e* of the retainer 42 is adapted to engage the outer annular surface 40*b* of mandrel adapter 40 and packing surface 38*d* of mandrel body 38. Annular retainer tabs 42*f*, 42*g* are adapted to be received in retainer detents 40*c*, 38*a*, respectively, for securing the mandrel adapter 40 with the mandrel body 38. Prferably, the retainer 42 is formed having a conic annular surface 42*h* adjacent the upper end thereof and is adapted to be substantially aligned with fluid ports 40*g* formed in the mandrel adapter 40 for the reasons discussed more fully hereinbelow. Mandrel packing 44 is mounted about packing surface 38*d* of the mandrel body 38 between the retainer 42 and retainer 46. Preferably, the mandrel packing 44 is of any suitable packing material capable of preventing fluid migration between moving elements. The mandrel packing 44 is adapted to abut lower end surface 42*i* of retainer 42 and upper end surface 46*e* of retainer 46 with the lower end surface 46*b* adapted to abut the upper end surface 38*k* of the longitudinal splines 38*f* of the mandrel body 38 (FIG. 3). Preferably, the retainer 46, much as retainer 42, is of a multiple "split-body" part construction which is secured together by suitable retainer ring 46*c* which is adapted to be disposed within the retainer ring detent 46*d*. Furthermore, the retainer 46 is formed having a recess 46*e* which is adapted to engage annular ring 381 formed with the mandrel body 38 adjacent the upper end 38*b* thereof for properly positioning the retainer 46 with the mandrel body 38 and to properly secure the mandrel packing 44 between the retainers 42, 46.

Preferably, a spacer sleeve 48 is mounted adjacent to the inner surface 20*c* of middle body 20 with the lower end 48*a* thereof having its end surface 48*b* in abutting relation to end surface 22*d* of spline body 22, with an appropriate seal 50 (FIG. 2C) being mounted wiht the spacer sleeve 48 adjacent thereto. The outer annular surface 48*c* corresponds substantially to the inner surface 20*c* of middle body 20 and is adapted to be received therein with the inner annular surface 48*d*. The spacer sleeve 48 is in sealable relation with the mandrel packing 44 and has an inside diameter slightly greater than the outside diameter of the retainer 42, 46. As such, the retainers 42, 46 do not contact the inner annular surface 48*d* of the spacer sleeve 48. Preferably, a suitable seal 52 (FIG. 2B) is mounted with the spacer sleeve 48 adjacent the upper end 48*e* thereof, with the seals 50, 52 insuring fluid tight relation between the outer surface 48*c* of the spacer sleeve 48 and the inner surface 20*c* of middle body 20. Furthermore, an impingement sleeve 54 (FIG. 2A) is adapted to be disposed within the inner surface 20*c* of middle body 20 with the upper end surface 54*a* in engagement with the end surface 18*h*. The outer annular surface 54*b* of impingement sleeve 54 is adapted to substantially engage inner surface 20*c* of middle body 20 in sealable relation with seals 56, 58 mounted with the outer annular surface 54*b*. The impingement sleeve 54 is further formed having an inner annular surface 54*c* and lower end surface 54*d*.

The shock absorber assembly S of the present invention further includes fluid dampening means F floated within the body member B in engagement with the body member B and mandrel M for absorbing shocks transmitted between the body member B and mandrel M. The fluid dampening means F includes a tank memer 60 as best seen in FIGS. 2A, 2B. The tank member 60 has an outer annular surface 60*a* which is of a lesser diameter than the inner surface 20*c* of middle body 20, wherein the tank member 60 is disposed. The tank member 60 is formed having a radial lip 60*b* adjacent the upper end 60*c* thereof, with an annular surface 60*d* formed adjacent radial lip 60*b*. Preferably a suitable opening 60*e* is formed adjacent to the annular surface 60*d*, with the opening 60*e* having a threaded portion 60*f* for receiving a suitable plug 60*g* for the reasons discussed more fully hereinbelow. Preferably the tank member 60 further includes a conically shaped upper end surface 60*h* and an interior surface 60*i*. A suitable tank top designated generally as 60*j* is secured to the lower end 60*k* of the tank member 60 by an appropriate weldment 601, with the annular surface 60*m* of the tank top 60*j* engaging the interior surface 60*i* of the the tank member 60. The tank top 60*j* further includes an outer annular surface 60*n*, tapered surface 60*o*, and outer annular surface 60*p* which is of lesser diameter than the annular surface 60*m*. The lower end 60*q* of the tank top 60*j* is formed having suitable threads 60*r* for threadedly engaging threads 60*s* of packing retainer 60*t*. Preferably the packing retainer 60*t* is formed having a suitable tool detent 60*u* and is adapted to be engaged by a suitable tool (not shown) for rotating the packing retainer 60*t* such that threads 60*r*, 60*s* may appropriately and tightly engage one another. A suitable retaining ring 60*v* is adapted to be mounted in groove 60*w* formed in the lower end 60*q* of the tank top 60*j* for securing the packing retainer 60*t* in its proper location, with seal 60*x* insuring a fluid tight relation adjacent threads 60*r*, 60*s*. The packing retainer 60*t* is formed having a wiper detent 60*y* and support detent 60*z*. A piston wiper 60*aa* is adapted to be mounted within wiper detent 60*y* with packing support 60*bb* being adapted to be mounted with the support detent 60*z*, having packing material 60*c* therewith. The packing support 60*bb* has a suitable seal 60*dd* for sealably engaging the packing retainer 60*t*. The packing support 60*bb* is adapted to further engage inner annular surface 60*ee* formed with the tank top 60*j* while packing support 60*ff* having suitable packing material 60*gg* therewith, in similar fashion engages inner annular surface 60*ee*, with seal 60*hh* insuring a fluid tight relation therebetween. Packing material 60*ii* is mounted with the tank top 60*j* adjacent inner annular surface 60*jj* which permits the packing material 60*ii* to abut packing support 60*ff*. Annular surface 60*kk* is formed adjacent to the annular surface 60*jj*. It will be appreciated that the annular surface 60*kk*, packing material 60*ii*, packing support 60*ff*, packing material 60*gg*, packing support 60*bb*, packing material 60*cc*, packing retainer 60*t* and piston wiper 60*aa* all form generally the opening 60*ll* of the tank member 60.

The fluid dampening means F further includes a piston 62 mounted for movement in opening 60*ll* of the tank member 60. The piston 62 includes an engaging surface 62*a* (FIG. 2C), an outer annular surface 6*b*, end surface 62*c*, and an inner annular surface 62*d*. The piston 62 is mounted for movement within the opening 60*ll* with the outer annular surface 62*b* being in a fluid tight relationship with the tank member 60 by means of piston wiper 60*aa*, packing material 60*cc*, 60*gg*, and 60*ii* sealably engaging the outer annular surface 62*b* of the piston 62 as the piston 62 reciprocates longitudinally within the opening 60*ll*. The piston wiper 60*aa* and packing material 60*cc*, 60*gg*, 60*ii* comprise the packing means designated generally as 64 of the present invention, with the packing means 64 disposed between the piston 62 and the opening 60*ll* of the tank member 60 for insuring a fluid tight relationship therebetween the piston 62 and tank member 60. Preferably, a plurality of stabilizing tabs 66, 68 are annularly mounted with the tank member 60 about the outer annular surface 60*a* thereof adjacent the upper end 60*c* and the tank top 60*j*, respectively. Preferably, the outer annular surface 66*a*, 68*a* of the stabilizing tab 66, 68 is of an outside diameter less than that of the interior surface 20*c* of middle body 20 thus permitting clearance between the stabilizing tabs 66, 68 and the middle body 20. The interior surfaces 66*b*, 68*b* are in abutting relation with the outer annular surfaces 60*a* of tank member 60 and outer annular surface 60*n* of tank top 60*j*, respectively.

The fluid dampening means F further includes sleeve insert 70 (FIG. 2A) that is mounted with the upper end 60*c* of tank member 60 such that the lower end surface 70*a* of sleeve insert 70 is in abutting relation with the radial lip 60*b*, with the inner surface 70*b* of sleeve insert 70 in contact with annular surface 60*d* of tank member 60, and with the upper end surface 70*c* of sleeve insert 70 in abutting relation to the radial surface 18*f* of top sub 18. Furthermore, the outer annular surface 70*d* preferably abuts annular surface 18*g* of the top sub 18 with the sleeve insert 70 being formed having a plurality of openings 70*e* formed extending therebetween the inner surface 70*b* and outer annular surface 70*d*.

The interior surface 60*i* of the tank member 60 as well as surface 60*mm* of tank top 60*j*, end surface 62*c* of piston 62, inner annular surface 62*d* of piston 62, and inner end surface 62*e* of piston 62, all coact to form and define cavity 72 within the fluid dampening means F that is adapted to receive a suitable compressible fluid 74 therein. Preferably, the compressible fluid is formed of a combination of hydrocarbon oil and silicone fluid. The compressibility of the compressible fluid 74 may accordingly be altered and/or changed by varying the ratios of hydrocarbon oil to silicone fluid to result in various compressibility ratios. Other fluids such as water and the like may be used; however, it is preferred that the combination of hydrocarbon oil and silicone fluid be used as the best results have been achieved using such combinations. Removal of plug 60*g* (FIG. 2A) permits the filling of cavity 72 with the appropriate compressible fluid, whereinafter the plug 60*g* is replaced. As such, movement of the piston 62 is an upwardly direction with respect to the tank member 60 results in compression of the compressible fluid 74 within the sealed cavity 72 of the fluid dampening means F. The greater the travel of the piston 62 upwardly into the tank member 60, the greater the compression of the compressible fluid 74 within cavity 72.

The shock absorber assembly S of the present invention is typically used in conjunction with rotary drilling operations wherein a working fluid such as drilling fluid (not numbered) is forced through the drill string 10 thereinto the shock absorber assembly S of the present invention to be utilized by the drill bit 12 in drilling operations. The drilling fluid enters the shock absorber assembly S of the present invention through the bore **18*b* of top sub 18 and flows thereinto the cavity 76 within the sleeve insert 70, through opening 70*e* in sleeve insert 70 thereinto cavity 78 defined as between the outer annular surface 70*d* of sleeve insert 70 and inner annular surface 54*c* of impingement sleeve 54. Thereafter the fluid flows between and around the plurality of stabilizing tabs 66 thereinto annular cavity 80 formed between the outer annular surface 60*a* of tank member 60 and inner surface 20*c* of middle body 20, about and around the plurality of stabilizing tabs 68 thereinto annular cavity 82, defined as between the outer annular surface 62*b* of piston 62 and the inner annular surface 48*d* of spacer sleeve 48. Thereafter the fluid flows through plural fluid ports 40*g* formed in mandrel adapter 40, into the central bore 38*c* of mandrel body 38 and thereafter into the drill bit 12 for use by same in drilling the well bore 14**. Thus, simply stated, the drilling fluid flows into the central portions of the body member B of the shock absorber assembly S and thereabout the fluid dampening means F which is centrally disposed within the shock absorber assembly S, and outwardly therefrom through the central portion of the mandrel M for use in rotary drilling operations.

Figure 2C:
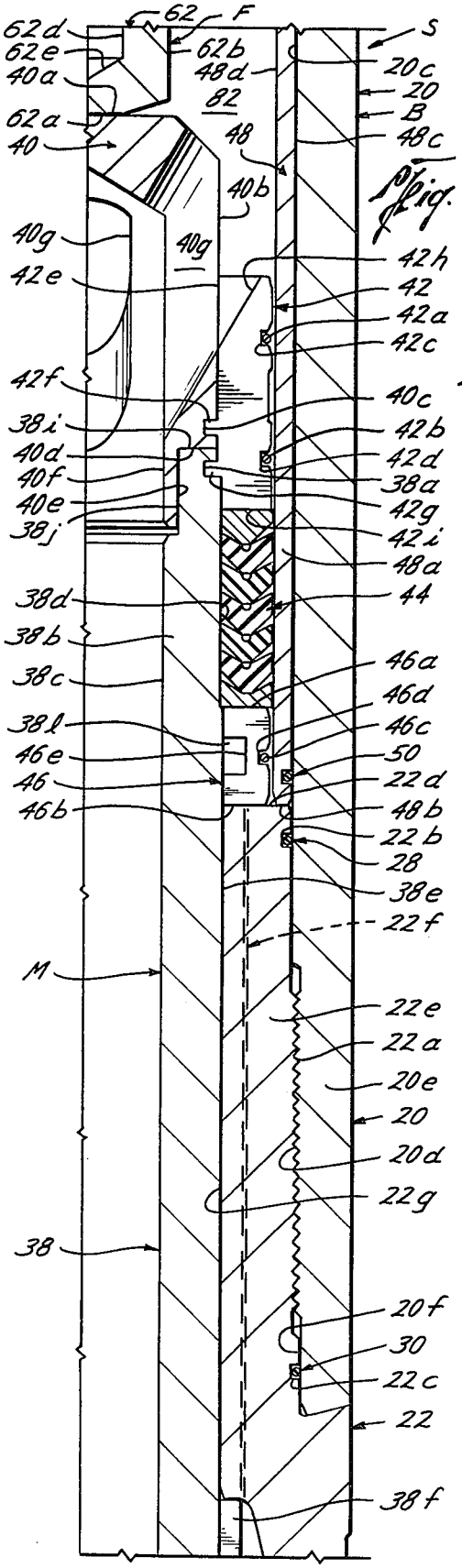
FIG. 2C is an elevational, sectional view of the shock absorber assembly of the present invention taken along the lines 2C—2C of FIG. 1.
Figure 2D:
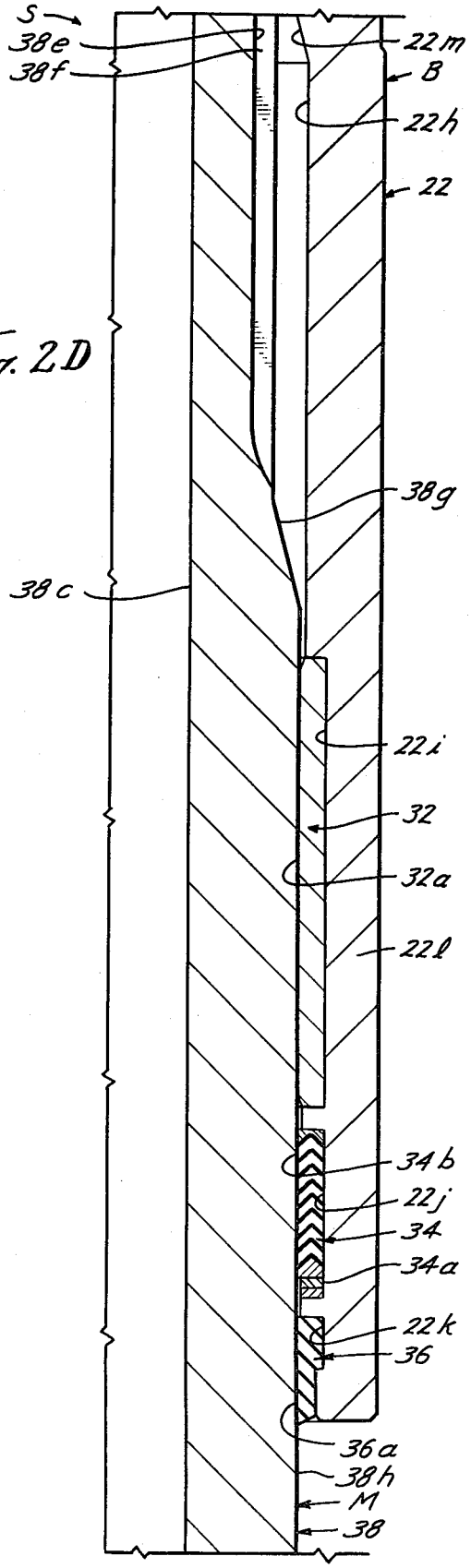
FIG. 2D is an elevational, sectional view of the shock absorber assembly of the present invention taken along the lines 2D—2D of FIG. 1; and, FIG. 3 is an elevational, sectional view of a portion of the fluid dampening means of FIGS. 2B and 2C showing the fluid dampening means in a compressed position.

Typically, the drill bit 12 encounters varying amounts of resistance in drilling through the multiple layers of geologic formations 16. As a result, shock vibrations are experienced by the drill bit 12 while drilling, with such shocks and vibrations capable of causing serious damage to the drill bit 12 and other drill string components not shown. Accordingly, the shock absorber assembly S of the present invention is utilized for minimizing and reducing such shocks and vibrations encountered by the drill bit 12 during such drilling operations. In a normal no-load or minimal loading situation, the upper end surface **40*a* of mandrel adapter 40 of the mandrel M is in abutting engagement with the engaging surfaces 62*a* of the piston 62, as shown in FIG. 2C, with the positioning of the piston 62 being substantially as shown in FIG. 2B. Rotation of the drill string 10 results in rotation of the top sub 18, middle body 20, spline body 22 of the body member B and the mandrel body 38 of mandrel M because of the engagement of the splines 38*f* with the spline grooves 22*f* formed in spline body 22. Accordingly, rotation of the body member B results in rotation of the mandrel M which in turn is affixed with the drill bit 12. However, with the splined relationship, the mandrel M is capable of reciprocal movement within the body member B because of the engagement between the splines 38*f* and spline grooves 22*f*. The upward travel of the mandrel M is limited to engagement of surfaces 38*g*, 22*m* (FIG. 2D) under extreme compression and the lower travel is limited by the engagement of retainer 46 with surface 22*d* (FIG. 2C) of spline body 22. Such longitudinal reciprocal movement is caused by vibrations and shocks encountered by the drill bit 12 during drilling operations. The longitudinal reciprocal movement of the mandrel M is transmitted to the fluid dampening means F by the contact of the piston 62 with the mandrel adapter 40. Upward movement of the mandrel M results in upward movement of the mandrel body 38, mandrel adapter 40, and piston 62 with respect to the body member B from a position illustrated in FIGS. 2B, 2C to that of a position shown in FIG. 3. This upward movement of the piston 62 with respect to the tank member 60 results in compression of the compressible fluid 74 within the cavity 72 of the tank member 60. The greater the movement of the piston 62 into the tank member 60, the greater the compression of the compressible fluid 74, thus dissipating the effects of the shock and vibrations upon the drill bit 12. By varying the volume of the cavity 72 within the tank member 60** or by varying the ratios of relative components of compressible fluid and/or both, a desired spring rate necessary for effecting appropriate shock absorption may be accomplished for drilling operations.

As such, the shock absorber assembly S of the present invention is allowed to "float" within the body member B and mandrel M of the present invention inasmuch as the fluid dampening means F is disposed within the body member B such that the sleeve insert 70 abuts the top sub 18 adjacent radial surface **18*f* while the engaging surface 62*a* of the piston 62 contacts the mandrel adapter 40 adjacent the lower end thereof with the stabilizing tabs 68, 70** loosely centering the fluid dampening means F within the central portion of the shock absorber assembly S. Thus the shock absorber assembly is not rigidly secured by any fastener to the body member B. Accordingly, the fluid dampening means F may be subjected only to axial pressure stresses; no axial bending may occur at the fluid dampening means F to cause detrimental effects to the various sealing and packing components thereof during high pressure and stress operations because of its "floatation" within the body member B.

Furthermore, inasmuch as the working fluid flows about the fluid dampening means F, such fluid acts as a coolant to cool down the heat generated by the fluid dampening means F during repeated compression of the compressible fluid 74 within cavity 72. This becomes significant because the effect of heat on a compressible fluid may appreciably change the dampening rate by increasing the same to such a level that effective shock absorbing isolation may not be effectuated. Thus, the cooling effect of the working fluid helps to promote the desired shock absorbing action to be performed by the shock absorber assembly S of the present invention.

It will be appreciated that the fluid dampening means F may be easily removed from the body member B and mandrel M and replaced with another fluid dampening means F, by merely unthreading the threaded engagement between threads **22*a*, 20*d*, removing the fluid dampening means F to be replaced and inserting a different one instead. This procedure may be used in the event of damage to a fluid dampening means F or in the situation where a different dampening rate may be desired by substituting a fluid dampening means F having a different volume of cavity 72 therein or having a different density compressible fluid and/or both. Furthermore, the major wear components of the shock absorber assembly S of the present invention are easily replaceable as is the mandrel adapter 40, the fluid dampening means F, as well as sleeve insert 70 and impingement sleeve 54 without necessitating replacement of the entire tool, with such replacement operations being easily done by merely unthreading the spline body 22 from the middle body 20** is discussed hereinabove.

It will further be appreciated that the spring or dampening rate of the fluid dampening means F is not constant in that the greater the movement of the piston 62 into the tank member 60, the greater the compression of the compressible fluid 74 within the cavity 72, resulting in increasingly greater resistance to compression. The resultant variable spring rate or compression prevents a resonant condition to occur which could cause chatter and consequent damage to the drill bit 12 during drilling operations. For example, on a 6⅝ inch API regular tool joint, typical dampening or spring rates vary between 13,000 psi and 30,000 psi during typical loading of the drill bit 12 which may span from 24,000 to 110,000 pounds. Thus, the shock absorber assembly S of the present invention may be used on and during drilling operations wherein the drill bit 12 encounters a wide variety of adverse shocks and vibrations.

Thus, the shock absorber assembly S of the present invention provides a new and improved tool for isolating, eliminating and/or or reducing the effects of shock and vibrations during rotary drilling operations. The shock absorber assembly S of the present invention and the method of using same permits varying the dampening rates while permitting cooling of the fluid dampening means F while also providing a tool capable of having a replaceable fluid dampening means that is easily removed and replaced for continuous operations.

The foregoing disclosure and description of the invention are explanatory and illustrative thereof, and various changes in the size, shape, and materials, as well as in the details of the illustrated construction, may be made without departing from the spirt of the invention.

We claim:

1. A shock absorber assembly for use with a drill string having working fluid therein, comprising:

a body member affixed to the drill string and in communication with the working fluid, said body member formed having a central bore therethough, said body member including a top sub, a middle body, and a spline body;

a mandrel mounted for reciprocal longitudinal movement with respect to said spline body of said body member and for directing the working fluid outwardly from said body member, said mandrel formed having a central bore therethrough;

fluid dampening means floated within said central bore of said body member wherein the working fluid flows about said fluid dampening means;

a mandrel adapter removably mounted with an upper end of said mandrel for engaging said fluid dampening means;

at least two retainer body parts, each of said retainer body parts being formed having at least two retainer rings, at least one of said retainer rings is receivably mounted within a retainer detent formed in said mandrel adapter and at least one of said retainer rings is receivably mounted within a retainer detent formed in said mandrel, said retainer body parts securing said mandrel adapter with said mandrel; and, said fluid dampening means engaging said mandrel for movement thereof in response to movement of said mandrel for absorbing shocks transmitted between said mandrel and said body member.

2. The shock absorber assembly of claim 1, further including:

an impingement sleeve mounted with said body member adjacent a lower end of said top sub and a upper end of said middle body adjacent to said sleeve insert;

said sleeve insert having sleeve insert openings formed therein for directing the working fluid from said central bore of said top sub of said body member through said sleeve insert openings onto said impingement sleeve;

and, said impingement sleeve preventing excessive wear of said upper end of said meddle body due to flow of the working fluid about said fluid dampening means.

3. The shock absorber assembly of claim 1, wherein:

said mandrel adapter is formed having a plurality of mandrel adapter ports directing flow of working fluid from about said fluid dampening means thereinto the said central bore of said mandrel.

4. The shock absorber assembly of claim 1, wherein:

said body member and said mandrel are rotatably interconnected whereby rotational movement of said body member imparts rotational movement to said mandrel.

5. The shock absorber assembly of claim 3, further including:

a spacer sleeve mounted with said body member adjacent said lower end of said middle body and adjacent said upper end of said spline body.

6. The shock absorber assembly of claim 1, further including:

a spline retainer mounted with said upper end of said mandrel for abutting said spline body of said body member upon full, longitudinal extension of said mandrel with respect to said body member.

7. The shock absorber assembly of claim 1, further including:

mandrel packing means disposed between said mandrel adapter and said spline retainer for preventing the flow of the working fluid between said mandrel and said spline body.

8. The shock absorber assembly of claim 1, wherein said fluid dampening means includes:

a cylindrical tank member for receiving a compressible fluid therein, said tank member having an opening formed adjacent to lower end thereof, and, a piston mounted for movement in said opening of said cylindrical tank member for compressing said compressible fluid within said tank member for dampening shocks and vibrations transmitted thereto;

a sleeve insert mountable with said top sub of said body member and with an upper end of said cylindrical tank member; and, said piston in abutting engagement with said mandrel for movement thereof in response to movement of said mandrel for absorbing shocks transmitted between said mandrel and said body member.

9. The shock absorber assembly of claim 8, further including:

stabilizing tabs mounted with said tank member for stabilizing said tank member and said piston of said fluid dampening means within said middle body of said body member.

10. The shock absorber assembly of claim 8, further including:

packing means between said piston and said opening of said tank member to prevent fluid communication between said compressible fluid within said tank member and the working fluid within said body member.

11. The shock absorber assembly of claim 8, wherein: said piston is formed in a substantially cylindrical configuration having an engaging surface, an annular wall surface and an open end surface, with said open end surface adapted to be mounted adjacent said opening of said tank member for reciprocal movement with respect thereto.

* * * * *